US007270167B1

(12) United States Patent
Aversenti et al.

(10) Patent No.: US 7,270,167 B1
(45) Date of Patent: Sep. 18, 2007

(54) METAL IMPREGNATED GRAPHITE COMPOSITE TOOLING

(75) Inventors: Edmund Aversenti, Chester, NJ (US); Allen Solomon, Grand Prairie, TX (US)

(73) Assignee: GMIC Corp., Linden, NJ (US)

( * ) Notice: Subject to any disclaimer, the term of this patent is extended or adjusted under 35 U.S.C. 154(b) by 92 days.

(21) Appl. No.: 11/003,715

(22) Filed: Dec. 3, 2004

(51) Int. Cl.
*B22D 19/14* (2006.01)
*B22D 23/00* (2006.01)
*B29C 33/38* (2006.01)

(52) U.S. Cl. ..... 164/46; 164/97; 164/19; 264/219

(58) Field of Classification Search ..... 164/46, 164/19, 97, 98; 264/219
See application file for complete search history.

(56) References Cited

U.S. PATENT DOCUMENTS 3,336,181 A * 8/1967 Falkenau et al. ..... 442/31
3,384,463 A 5/1968 Olstowski et al.
3,918,141 A 11/1975 Pepper et al.
3,953,647 A 4/1976 Brennan et al.
4,141,802 A * 2/1979 Duparque et al. ..... 205/117
4,223,075 A 9/1980 Harrigan, Jr. et al.
4,775,547 A 10/1988 Siemers
5,122,422 A 6/1992 Rodhammer et al.
5,211,776 A 5/1993 Weiman
5,514,480 A 5/1996 Takagi et al.
5,609,922 A 3/1997 McDonald
5,695,883 A 12/1997 Harada et al.
5,783,259 A 7/1998 McDonald
5,817,267 A 10/1998 Covino et al.
5,837,959 A 11/1998 Muehlberger et al.
5,855,828 A 1/1999 Tuffias et al.
5,879,747 A 3/1999 Murakami et al.
5,897,922 A 4/1999 Saxena et al.
5,933,703 A 8/1999 Robertson
5,952,056 A 9/1999 Jordan et al.
6,197,386 B1 3/2001 Beyer et al.
6,309,587 B1 10/2001 Gniatczyk et al.
6,342,272 B1 1/2002 Halliwell
6,447,704 B1 * 9/2002 Covino ..... 264/219
6,613,266 B2 9/2003 McDonald
6,623,808 B1 9/2003 Jordan et al.
6,672,125 B2 1/2004 Kenney et al.
2001/0041227 A1 11/2001 Hislop
2002/0150645 A1 10/2002 Covino
2003/0003329 A1 1/2003 Wang et al.
2003/0068515 A1 4/2003 Holmqvist et al.
2003/0127775 A1 7/2003 McDonald
2003/0129437 A1 7/2003 Kawaguchi et al.

OTHER PUBLICATIONS silpak.com website printout, Spray Metal Tooling.
Argento et al., *Report Brief*, Design of Composite Shafts with Damping Layers for High Speed Machining Processes, pp. 93-95, Jun. 4, 2003.
azom.com website printout, Thermal Spraying—An Overview.

(Continued)

*Primary Examiner*—Kevin P. Kerns
(74) *Attorney, Agent, or Firm*—Lerner, David, Littenberg, Krumholz & Mentlik, LLP

(57) ABSTRACT

A metallic shell used, for example as a mold, is formed by spray deposition of metallic layers over non-metallic layers as, for example, a reinforcing fabric.

45 Claims, 2 Drawing Sheets

OTHER PUBLICATIONS compositesworld.com website printout, Industry Overview: Tooling considerations and mold releases.

M. Ferrara, *ACPT Advanced Composite Products & Technology*, Getting Shafted, Turbo & High Tech Performance, Oct. 1996.

Dura-Light® Carbon Fiber Shafts, Unique Features of Dura-Light Bladder Shafts; product information.

Touchstone Research Laboratory, "The Innovation Laboratory", Aug. 25, 2004 (1 page) http://www.trl.com/developments/cfoam.html.

Touchstone Research Laboratory, "Super-Carbon Foam", Aug. 25, 2004 (1 page) http://www.cfoam.com/.

Touchstone Research Laboratory, "Carbon Foam Applications" Aug. 25, 2004 (2 pages) http://www.cfoam.com/applications.html.

* cited by examiner

METAL IMPREGNATED GRAPHITE COMPOSITE TOOLING

FIELD OF THE INVENTION

The present invention relates to the thermal spraying of tools, more specifically, the present invention relates to metallic thermal sprayed tools having layers of non-metallic sheets impregnated therein.

BACKGROUND OF THE INVENTION

Industrial processes such as molding and layup of composite materials, thermoforming, injection molding and reaction injection molding require tools having shapes specific to the article to be made. For example, a composite article can be formed in a mold having an internal shape corresponding to the shape of the desired article by laying up fibers and a matrix composition such as an epoxy or other polymeric material on the surface of the mold and curing the polymer composition. In some cases, the fibers and composition are held between two mating mold parts so that the fibers and composition are squeezed between the surfaces of the mold parts. In reaction injection molding, two or more mating mold parts are brought together to form a substantially closed cavity and a reactive polymer composition is placed within the cavity and cured to form a shape corresponding to the shape of the cavity.

There has been an ever-increasing need for large molds in numerous industries. For example, in the aerospace industry, the increasing prevalence of composite structural materials in airframes has lead to a substantial need for practical large molds. These molds often must meet demanding conditions in use. For example, composite parts used in airframes must meet exacting standards for fit and finish and often incorporate complex curved surfaces. Also, many useful materials such as carbon-fiber reinforced graphite composites must be molded at relatively high temperatures. Molds formed from alloys having low coefficients of thermal expansion such as nickel alloys are preferred for bonding these materials.

Thus, the importance of these molds is evident. However, the process of creating such molds has been somewhat difficult. While tools for fabrication of small parts are often machined from solid metals, using conventional machining techniques, these techniques are impractical in the case of very large molds, having dimensions of a meter or more. The cost of machining these large molds from solid blocks of material is prohibitive. However, there have been several innovative and cost effective methods for fabricating such molds proposed.

As described in greater detail in commonly assigned U.S. Pat. No. 5,817,267 ("the '267 patent") and U.S. Pat. No. 6,447,704 ("the '704 patent"), the disclosures of which are hereby incorporated by reference herein, molds and other tools of essentially unlimited dimensions may be formed from a wide variety of metals, including low-expansion nickel and iron alloys, by a thermal spraying process. As described in certain embodiments of the '267 patent, a shell having a working surface with a desired shape can be formed by providing a matrix having the desired shape and spraying droplets of molten metal using a thermal spray gun, such as a plasma spray gun or arc spray gun onto the matrix. Such spraying can be used to build up the metal to a substantial thickness, typically about one-quarter inch (6 mm) or more. During the deposition process, the spray gun is moved relative to the matrix so that the spray gun passes back and forth over the surface of the matrix in a movement direction and so that the spray gun shifts in a step direction transverse to the movement direction between passes. Thus, during at least some successive passes, metal is deposited on the same region of the matrix from two different spray directions in a "crisscross" pattern. The resulting shells have substantial strength and good conformity with the matrix to provide a faithful reproduction of the matrix shape. Although the '267 patent is not limited by any theory of operation, it is believed that deposition of the metal in different spray directions can produce an interwoven pattern of metal droplets and/or metal grains in the deposited shell, and that this produces a stronger, generally better shell.

While the fabrication of large molds, as taught in the '267 and '704 patents, is indeed innovative and cost effective, there is room for improvement. The successful method of fabricating molds as taught in these patents provides a mold that adheres to strict standards placed upon the products for which it is utilized to create. However, the durability of the molds may be improved. Typically, molds of this type are very heavy, which makes them both costly to manufacture and difficult to handle. Similarly, molds in accordance with the '267 and '704 patents are rather large, their vast size coupled with their significant weight making it difficult for them to hold their shape and exact dimensions. Additionally, molds of this type are housed and utilized in an industrial working environment, such as a manufacturing facility, where the molds can be damaged. While damage of this type may be mended, it is often an expensive repair process. The durability of the mold may be improved by incorporation more material into the mold. However, this not only creates cost issues, but also increases the overall weight of the mold.

Therefore, there exists a need for a more durable mold for use in large scale industrial molding processes.

SUMMARY OF THE INVENTION

A first aspect of the present invention is a method of making a metal and non-metallic fiber composite mold. The method includes the steps of providing a matrix having a shape to be molded, providing an underlying metal layer on the matrix, placing a sheet over the underlying metal layer, the sheet including a plurality of filaments, the filaments being spaced apart from one another and defining gaps therebetween, and then spray depositing an additional metal layer by making a plurality of passes with at least one spray gun so that the metal of the additional metal layer merges with the metal of the underlying metal layer in the gaps.

Another embodiment of the present invention is another method of making a metal and non-metallic fiber composition. The method includes the steps of providing a matrix having a shape to be molded, providing an underlying metal layer on the matrix, placing a sheet over the underlying metal layer, the sheet including a plurality of filaments, and then spray depositing an additional metal layer by making a plurality of passes with at least one spray gun so that the metal of the additional metal layer merges with the metal of the underlying metal layer. During at least a part of the spray depositing step, the sheet is restrained against the underlying metal layer.

Another aspect of the present invention is a method of molding including providing a mold including a unitary metallic structure having non-metallic reinforcing fibers embedded therein, applying a composition to be molded so that the composition contacts the metallic structure, and curing the composition.

Yet another aspect of the present invention is a mold including a unitary metallic structure having non-metallic reinforcing fibers embedded therein. The structure defining a surface having a shape corresponding to the shape of an article to be molded. The surface being at least one square meter in area.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

In describing the preferred embodiments of the subject matter illustrated and to be described with respect to the drawings, specific terminology will be used for the sake of clarity. However, the invention is not intended to be limited to any specific terms used herein, and it is to be understood that each specific term includes all technical equivalents which operate in a similar manner to accomplish a similar purpose.

A process for making a mold in accordance with one embodiment of the present invention uses a matrix 10 (shown in FIG. 1) having an active surface 12 with a shape corresponding to the shape of the part to be molded. As described in greater detail in the '267 patent, the matrix desirably also includes edge regions 14 projecting outwardly from the active surface and side wall 16 extending between the edge regions and active surface 12. The matrix 10 can be formed from essentially any material having useful structural strength at the temperatures attained by the matrix during application of the sprayed metal, typically on the order of 220° F. (104° C.). Similarly, the matrix 10 can be formed by any conventional process. For example, high-temperature epoxy composite tooling compounds can be cast to its shape using a master tool (not shown). Readily machinable materials such as polymeric materials, metals such as aluminum or brass and graphite may be machined to shape using conventional methods such as numerically controlled machining methods to form the matrix. Although the matrix is depicted as a solid, unitary body, it may incorporate internal structures such as hollow spaces, reinforcing members such as metal bars or fibers and the like. Also, the matrix typically is supported on a supporting structure such as a table or machine bed.

Figure 1:
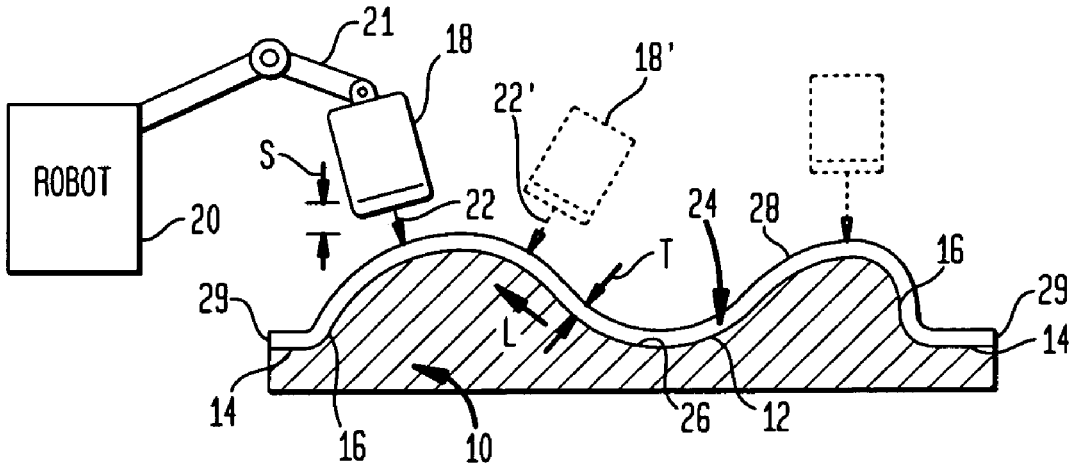
FIG. 1 is a diagrammatic partially sectional view depicting one stage during formation of the first layer of a mold in accordance with an embodiment of the present invention.

As is shown in FIG. 1, a thermal spray gun 18 linked to a conventional industrial robot 20 is used to spray deposit molten metal to the matrix. Thermal spray gun 18 may be a conventional plasma spray gun or an arc spray gun. For example, a typical spray gun such as that sold under the designation Model BP400 Arc Spray System by Miller Thermal, Inc. of Appleton, Wis. is arranged to apply an electrical potential to strike an arc between a pair of wires and to feed the wires continually into the arc while blowing a stream of a compressed gas through the arc. The stream carries a spray of metal droplets formed from the molten wire at a high velocity in a relatively narrow pattern extending from the front of the gun so that the droplets move principally in a spray direction 22. The sprayed metal droplets impinge on the active surface 12 of matrix 10 and deposit as a first layer 24 having a working surface 26 conforming to the shape of the active surface 12, wall 16, and edge regions 14 of the matrix. First layer 24 has a thickness direction T generally normal to the working surface 26 and hence normal to the active surface 12 of matrix 10. The layer also has lateral directions L transverse to the working surface 26. Thus, the lateral directions layer 24 (and of the formed shell as a whole) are the directions generally to the left and right and generally into and out of the plane of the drawing shown in FIG. 1.

A non-oxidizing gas such as nitrogen may be used as the gas in spraying and may be applied as a gas blanket over the area being sprayed. The use of such a non-oxidizing blanket minimizes oxidation of the metal during the process and promotes bonding of newly-sprayed metal to previously-sprayed metal.

The robot maintains spray gun 18 at a preselected standoff distance or spacing S from the matrix and from the deposited layer. The standoff distance will depend upon the spray conditions and the particular head employed, but most typically, in accordance with the present invention, is about 6-10 inches. As the metal is sprayed from spray gun 18, robot 20 moves the spray gun head 18 in a sweeping pattern over the active surface 12 and the adjacent walls and edge regions of the matrix. Desirably, the robot moves head 18 in a movement direction as, for example, into and out of the plane of the drawing as seen in FIG. 1 and shifts the head in a step direction transverse to the movement direction (to the left and right in FIG. 1) between passes. The robot generally situates spray gun 18 so that spray direction 22 is at a ninety degree angle with respect to active surface 12 of matrix 10 (further positions of the gun are shown in the depiction of spray gun 18' having spray direction 22' in FIG. 1). The "splat" or pattern of metal droplets hitting working surface 26 is assured substantially equal distribution when the spray direction 22 is situated at this ninety degree orientation with respect to active surface 12, something that is clearly desired in order to create a uniform first layer 24. However, it is contemplated that spray gun 18 may be situated so that spray direction 22 is at various angles, in certain situations, in order to more uniformly spray the metallic droplets. For example, active surfaces 12 that include severe or deep undulations may require an angled spray direction 22 to properly coat the surface with metal. The process of spraying the first layer 24 is continued until a desired thickness is achieved. For example, in certain embodiments, spray gun passes are made until thickness T is approximately 0.062 inches at every point over the entire area of first layer 24.

The material used to form first or first layer 24 is selected for compatibility with the material to be molded. Particularly in those applications involving elevated temperatures or substantial temperature changes during the molding operation, the material used to form the first layer is selected to have a low coefficient of thermal expansion and to provide substantial strength at elevated temperature. Merely by way of example, materials such as aluminum alloys, ferrous metals such as stainless steels and iron-nickel alloys can be used. Alloys formed predominantly from iron and nickel are particularly preferred for this purpose. As used in this disclosure, a metal formed "predominantly from" certain metals contain at least about 50% of those metals in the aggregate. Thus, a metal formed predominantly from iron and nickel contains at least about 50% iron and nickel in the aggregate and 50% or less of other materials by weight. Alloys of iron and nickel containing between about 30% and about 55% nickel and between about 45% and about 70% iron are particularly preferred. The most preferred low-expansion alloys are those containing about 36% nickel, such as those sold under the commercial designation INVAR®.

Figure 2:
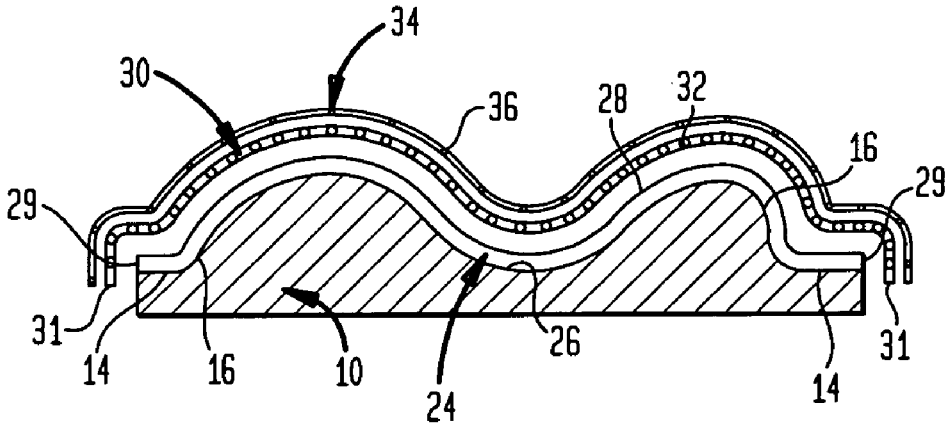
FIG. 2 is a view similar to that shown in FIG. 1 depicting the first sheet and the wire mesh prior to being placed onto the first layer.
Figure 3:
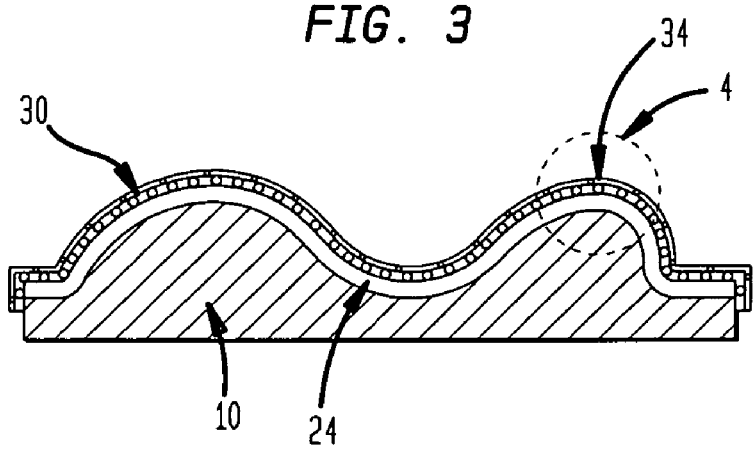
FIG. 3 is a view similar to that shown in FIGS. 1 and 2 depicting the first sheet and the wire mesh placed onto the first layer.

Once the desired thickness T of first layer 24 is achieved, the spray process is halted. At this point, first layer 24 is kept at a temperature of above at least 160° F. This may be accomplished through the use of external heating devices. With first layer 24 completely sprayed and in place, a first sheet 30, made up of a plurality of filaments 32, is placed on the outer surface 28 of first layer 24. This can be seen in FIGS. 2 and 3. First sheet 30 may be any material suitable for providing additional durability to shell. For example, in certain embodiments, first sheet 30 is a carbon fiber woven fabric, such as Boeing Material Specification 8-9. Sheets 30 in accordance with certain preferred embodiments of the present invention may include approximately 10-20 fibers per square inch and may have a thickness of approximately 0.001 to 0.005 inches. However, it is contemplated that in other embodiments, non-woven, non-metallic fibers may be utilized. Similarly, first sheet 30 may be of any thickness, for example, 0.0005 inches to 0.10 inches, more preferably 0.001 inches to 0.005 inches, and most preferably 0.002 inches. First sheet 30 is also configured and dimensioned so that its ends 31 wrap around first layer edges 29. This prevents first sheet 30 from flapping (i.e.—becoming detached from first layer 24) under the high-velocity gas spray of subsequent spraying steps. Prior to placing first sheet 30 over first layer 24, the individual filaments 32 are separated from one another in order to prevent "shadowing". As used herein, "shadowing" refers to the creation of areas where sprayed metal droplets cannot enter and impregnate the sheet. This shadowing problem would prevent proper bonding among first layer 24, first sheet 30, and any additional metal layers. The separating of filaments 32 can be done by hand, or in certain embodiments, filaments 32 can be pre-woven into first sheet 30 so that each filament 32 is substantially separated from one another. In certain preferred embodiments, the separation provides fiber gaps of approximately 0.00625 to 0.125 inches. However, other distances of separation of individual filaments 32 with respect to one another are contemplated.

A means for further holding down first sheet 30, such as wire mesh 34, is then placed over first sheet 30. This can also be seen in FIGS. 2 and 3. Wire mesh 34 is plurality of wires 36, which is utilized to further prevent first sheet 30 from flapping under the high velocity gas spray of subsequent spraying steps. The wire mesh should be constructed from a material that has a sufficient weight and stiffness to hold down first sheet 30. For example, in certain embodiments, wire mesh 34 may be constructed of stainless steel having approximately 0.125 inch gasp between each wire 36. It is contemplated that other devices can be utilized to further prevent the flapping phenomenon. For example, for molds lacking in extreme undulations, first sheet 30 may be held taut against first layer 24 by clamping its edges to the edge region 14 of matrix 10. In other embodiments, objects that proceed or follow spray gun 18 may be utilized. Objects of this type concentrate on preventing flapping in areas that are about to be sprayed, rather than the entire area of first sheet 30. Examples of such objects are rollers attached to spray gun 18 or other mold conforming devices.

Figure 4:
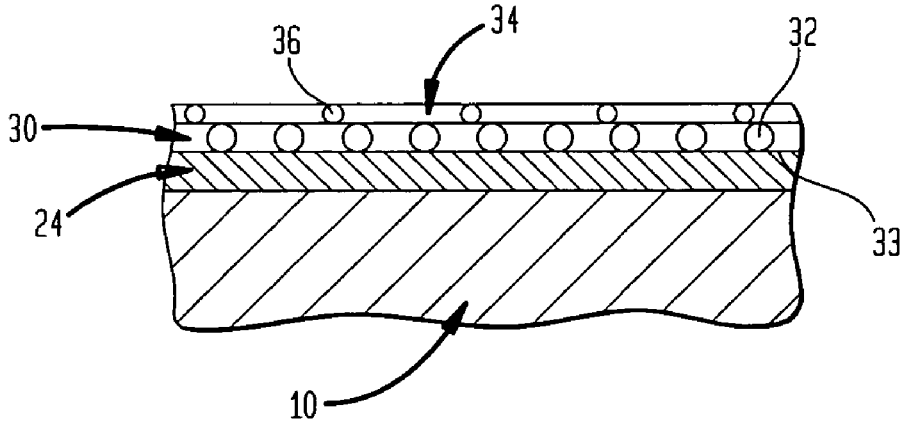
FIG. 4 is a fragmentary, diagrammatic sectional view on an enlarged scale depicting the region 4 indicated in FIG. 3.

With wire mesh 34 in place, spray gun 18 is utilized to spray a second layer 44 over first sheet 30. As was the case in the spraying of first layer 24, spray gun 18 is spaced a distance S from the outer surface 28 of first layer 24. However, to begin spraying second layer 44, spray gun 18 is angled so that spray direction 22 is approximately forty five degrees with respect to outer surface 28 of first layer 24. A single pass is then made with spray gun 18 oriented in this fashion. This forty five degree orientation allows for the sprayed metal droplets to, not only impinge in between each filament 32 of first sheet 30, but also to get under each individual filament 32 and deflect up onto the underside 33 (shown in FIG. 4) of first sheet 30. This in turn, enhances adhesion of first layer 24 to first sheet 30, and substantially eliminates the aforementioned shadowing problem. It is contemplated that spray gun 18 could be oriented at any oblique angle or in any manner that allows for this "bounce up" of the sprayed metal droplets onto underside 33 of first sheet 30. It is also contemplated that more than a single pass with spray gun 18 oriented at an angle may be made. For example, in certain embodiments, the single pass with spray gun 18 oriented at a forty-five degree angle with respect to outer surface 28 can be repeated with spray gun 18 oriented at an opposite forty-five degree angle with respect to outer surface 28. This second pass would allow for the "bounce up" of the sprayed metal droplets onto underside 33 of first sheet 30, from a different direction. Making multiple passes at opposite spray angles may provide the most desired adhesion of first layer 24 to first sheet 30.

Figure 5:
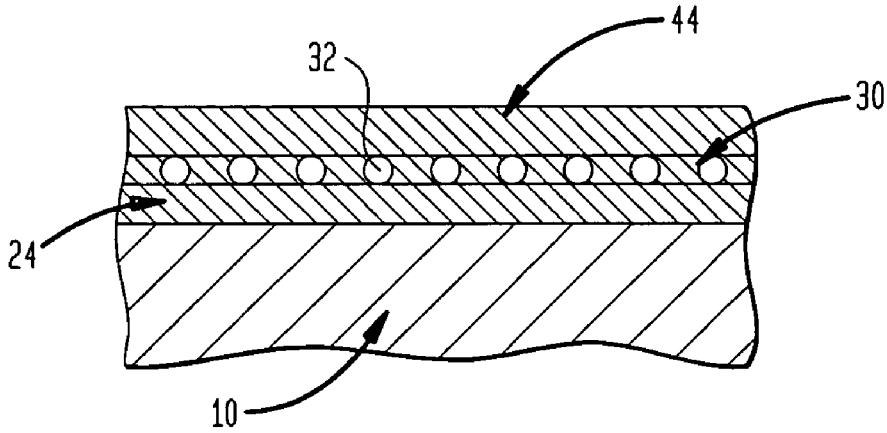
FIG. 5 is a fragmentary, diagrammatic sectional view on an enlarged scale depicting the region shown in FIG. 4 with a second layer spray deposited thereon.

After this single pass, spray gun 18 is reoriented in its standard ninety degree orientation, as discussed above, and one or more, typically two, additional passes are made with wire mesh 34 in place. The additional passes further bind first sheet 30 to the shell, but do not fully encapsulate the wires of mesh 34. Upon the completion of these additional passes, wire mesh 34 is removed from its position, leaving first sheet 30 with a semi-completed second layer 44 formed over it. Thereafter, spray gun 18 passes are continued, in the manner discussed above in the description of the formation of first layer 24, until a desired thickness of second layer 44 is achieved. Like that of first layer 24, the desired thickness may be any thickness, preferably approximately 0.062 inches at every point over the entire area of second layer 44. Although first layer 24, first sheet 30, and second layer 44 are depicted in FIG. 5 as separate layers for clarity of illustration, it should be appreciated that second layer 44 merges with first layer 24 and forms a unitary shell with first sheet 30 embedded therein.

The above steps may be repeated, thereby creating a shell with alternating layers of spray deposited metal (like that of first layer 24 and second layer 44) and carbon reinforcing sheets (like that of first sheet 30). In fact, the above steps may be repeated until any desired shell overall thickness is achieved. For example, in certain embodiments, the shell consists of four 0.062 inch sprayed metal layers and three 0.002 inch sheets, thereby having a total shell thickness of approximately one quarter inch. However, it is contemplated that other metal layer/sheet combinations can be utilized to achieve many different shell thicknesses. The end result of the above discussed steps is to from an integral, unitary shell, incorporating the metal spray deposited in all of the various layers, with the sheets disposed between each pair of adjacent metal layers.

The shell has a working surface 26 corresponding to the interior surface of first layer 24 and conforming to the shape of matrix 10. As described in greater detail in the '267 patent, the shell can be allowed to cool gradually, desirably over a period of several hours and preferably over a longer time before being removed from matrix 10. For example, very large molds may be cooled from about 150° C. to about 20° C. over a period of several weeks in a temperature controlled environment with subsequent cooling at normal room temperature. It is believed that such gradual cooling tends to stabilize the shell and prevent warpage when the shell is removed from matrix 10. As also described in the '267 patent, those portions of shell extending along side walls 16 of matrix 10 form ribs projecting from the remainder of the shell which further tend to stiffen the shell and reinforce it against warpage. Those ribs may remain in place in the finished shell or else may be removed after cooling.

The completed shell can be used as a mold or a mold component. For example, in reaction injection molding or blow molding, two such assemblies can be engaged with one another so that their shells form a closed cavity and a molten composition can be squeezed between the shells. In other processes such as thermoforming and some lay up processes, only one shell is employed.

As described in the '267 patent, the mold surfaces can be polished or otherwise treated to provide the desired surface finish. Also, the metal layers formed by thermal spraying may be porous or may be dense and substantially non-porous, depending upon the spray deposition conditions. The working surfaces of the mold may be impregnated with a polymer or with a metal such as nickel by electroplating or electroless plating. Polymeric coatings such as homopolymers and copolymers of tetrachlorethylene, flouranated ethylene propylene, perofluoro alkoxyethylene, acrylics, vinylidene fluorides and amides can be applied by conventional coating and impregnation techniques to enhance the release properties of the mold and to decrease its porosity. Surface treatments such as those sold under the registered trademarks TUFRAM and NEDOX, release agents such as those sold under the registered trademark PLASMADIZE and coatings such as those sold under the registered trademark LECTROFLUOR, all available from the General Magnaplate Corporation of Linden, N.J. may be applied on the working surfaces of the shells.

Finally, numerous variations and combinations of the features discussed above can be employed without departing from the present invention. It is contemplated that the above discussed steps for forming shell can be modified in accordance with certain embodiments of the present invention. For example, all three passes made with wire mesh 34 in place could be completed with the spray direction 22 being oriented in the forty five degree orientation. Similarly, wire mesh 34 can be placed on or removed from its position over first sheet 30 after any amount of passes of spray gun 18.

Also, it is not essential to form every metal layer by spray deposition. For example, the first or underlying layer 24 can be formed in part or in whole by other processes, such as by plating and the remaining thickness of the shell can be formed by the steps as discussed above.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of making a metal and non-metallic fiber composite mold comprising the steps of:

(a) providing a matrix having a shape to be molded;

(b) providing an underlying metal layer on said matrix;

(c) placing a sheet over the underlying metal layer, the sheet including a plurality of filaments, said filaments being spaced apart from one another and defining gaps therebetween; and then (d) spray depositing an additional metal layer by making a plurality of passes with at least one spray gun so that the metal of said additional metal layer merges with the metal of said underlying metal layer in said gaps;

(e) allowing the sheet to remain between the underlying metal layer and the additional metal layer and;

(f) restraining said sheet in position on said underlying layer during at least a part of said step of depositing said additional metal layer, wherein said restraining step includes providing a mesh over said sheet.

2. The method according to claim 1 wherein said step of spray depositing said additional metal layer includes making at least one pass with the spray gun having a spray direction at an oblique angle to a surface defined by the first metal layer and the sheet.

3. The method according to claim 2 wherein said step of spray depositing said additional metal layer includes making a plurality of passes with said spray direction in a plurality of different orientations relative to said surface.

4. The method according to claim 2 wherein said plurality of different orientations include two substantially opposite oblique orientations.

5. The method according to claim 1 further comprising repeating steps (c) and (d) to create a shell.

6. The method according to claim 5 further comprising the step of removing the shell from the matrix to form a mold.

7. The method according to claim 6 further comprising the step of using the mold in a molding process.

8. The method according to claim 5 wherein the shell is at least 0.1 inches thick.

9. The method according to claim 8 wherein the shell is about 0.25 inches thick.

10. The method according to claim 5 wherein the shell has an exterior surface area of at least one square meter.

11. The method according to claim 1, wherein said step of placing a sheet includes the step of separating the filaments of the sheet from one another to form or enlarge said gaps.

12. The method according to claim 1 wherein said step of providing said underlying metal layer includes spray-depositing said underlying metal layer by making a plurality of passes with at least one spray gun.

13. The method according to claim 1 wherein the spray gun is an arc spray gun.

14. The method according to claim 1 wherein the spray gun is a plasma spray gun.

15. The method according to claim 1 wherein the metal layers are constructed from the group consisting of iron, nickel, zinc, aluminum, and copper.

16. The method according to claim 1 wherein the metal layer is constructed from approximately 30-42% nickel.

17. The method according to claim 1 wherein the sheet is a carbon woven fabric.

18. The method according to claim 5 further comprising the step of sealing the shell by impregnating the shell.

19. The method according to claim 18 wherein said step of impregnating the shell includes the step of impregnating the shell with a polymeric material.

20. The method according to claim 18 wherein said step of impregnating the shell includes the step of plating a metal onto the shell.

21. The method according to claim 1 further comprising the step of forming a composite part in said mold.

22. A method of making a metal and non-metallic fiber composition comprising the steps of:

(a) providing a matrix having a shape to be molded;

(b) providing an underlying metal layer on said matrix;

(c) placing a sheet over the underlying metal layer, the sheet including a plurality of filaments; and then (d) spray depositing an additional metal layer by making a plurality of passes with at least one spray gun so that the metal of said additional metal layer merges with the metal of said underlying metal layer;

(e) allowing the sheet to remain between the underlying metal layer and the additional metal layer; and (f) during at least a part of step (d), restraining said sheet against said underlying metal layer with a restraining means.

23. A method as claimed in claim 22 wherein said restraining step includes providing a mesh over said sheet so that said mesh substantially conforms to a surface defined by said sheet, said spray-depositing step including directing metal from said spray gun through said mesh.

24. The method as claimed in claim 23 further comprising the step of removing said mesh after depositing an initial portion of said additional metal layer.

25. The method as claimed in claim 22 wherein said step of spray depositing the additional metal layer includes making at least one pass with the spray gun having a spray direction at an oblique angle to a surface defined by the first metal layer and the sheet.

26. The method as claimed in claim 25 wherein said step of spray depositing said additional metal layer includes making a plurality of passes with said spray direction in a plurality of different orientations relative to said surface.

27. The method as claimed in claim 25 wherein said plurality of different orientations include two substantially opposite oblique orientations.

28. The method as claimed in claim 22 further comprising repeating steps (c) and (d) so that the sheets and metal layers form a shell having a desired shell thickness.

29. The method as claimed in claim 28 further comprising the step of removing the shell from the matrix to form a mold.

30. The method as claimed in claim 29 further comprising the step of using the mold in a molding process.

31. The method as claimed in claim 28 wherein the shell is at least 0.1 inches thick.

32. The method as claimed in claim 31 wherein the shell is 0.25 inches thick.

33. The method as claimed in claim 28 wherein the shell has an exterior surface area of at least one square meter.

34. The method as claimed in claim 22 wherein the filaments of said sheet are spaced apart from one another and define gaps therebetween.

35. The method as claimed in claim 34 wherein said step of placing a sheet includes the step of separating the filaments of the sheet from one another to form or enlarge the gaps.

36. The method as claimed in claim 22 wherein said step of providing said underlying metal layer includes spray depositing said underlying metal layer by making a plurality of passes with at least one spray gun.

37. The method as claimed in claim 22 wherein the spray gun is an arc spray gun.

38. The method as claimed in claim 22 wherein the spray gun is a plasma spray gun.

39. The method as claimed in claim 22 wherein the metal layers are constructed from the group consisting of iron, nickel, zinc, aluminum, and copper.

40. The method as claimed in claim 22 wherein the metal layer is constructed from approximately 30-42% nickel.

41. The method as claimed in claim 22 wherein the sheet is a carbon woven fabric.

42. The method as claimed in claim 28 further comprising the step of sealing the shell by impregnating the shell.

43. The method as claimed in claim 42 wherein said step of impregnating the shell includes the step of impregnating the shell with a polymeric material.

44. The method as claimed in claim 42 wherein said step of impregnating the shell includes the step of plating a metal onto the shell.

45. The method as claimed in claim 22 further comprising the step of forming a composite part in said mold.

* * * * *